United States Patent [19]

Hoffman

[11] 4,332,987

[45] Jun. 1, 1982

[54] DIP SWITCH

[75] Inventor: Norman E. Hoffman, Harrisburg, Pa.

[73] Assignee: AMP Incorporated, Harrisburg, Pa.

[21] Appl. No.: 216,360

[22] Filed: Dec. 15, 1980

[51] Int. Cl.[3] ..... H01H 15/02

[52] U.S. Cl. ..... 200/16 D; 200/254

[58] Field of Search ..... 200/16 R, 16 B, 16 C, 200/16 D, 16 E, 16 F, 17 R, 254, 260, 290, 291, 292, 164 R

[56] References Cited

U.S. PATENT DOCUMENTS

| | | | |
|---|---|---|---|
| 3,467,922 | 9/1969 | Greenwall, Jr. et al. | 335/161 |
| 3,632,909 | 1/1972 | Rowley | 200/16 D |
| 3,728,499 | 4/1973 | Bang et al. | 200/16 F |
| 3,737,594 | 6/1973 | Rosmanith | 200/16 D X |
| 3,781,866 | 12/1973 | Kilby | 340/347 P |
| 3,786,206 | 1/1974 | Kurimsky | 200/16 D |
| 4,012,608 | 3/1977 | Lockard | 200/16 D |
| 4,068,202 | 1/1978 | Lyons | 335/207 |
| 4,152,565 | 5/1979 | Rose | 200/291 |
| 4,168,404 | 9/1979 | Lockard | 200/1 R |
| 4,211,900 | 7/1980 | Quigley | 200/5 R |

*Primary Examiner*—James R. Scott

*Attorney, Agent, or Firm*—Adrian J. La Rue; Richard B. O'Planick

[57] ABSTRACT

A DIP switch is disclosed comprising improved sliding actuator means receivable within a rectangular housing channel. The slide actuator comprises a dielectric body having a plurality of parallel arms projecting forward therefrom, with each of the arms having a free, reversely formed end segment projecting backward in superior relationship to the actuator body. The slide actuator further comprises a plurality of parallel conductive arms, electrically and mechanically connected at one end, and projecting rearwardly from the actuator body. Each of the conductive arms is formed to provide a reversely-bent depending end segment projecting downwardly for engaging and interconnecting appropriate circuitry in the housing channel. A cover is further provided for enclosing the top of the housing channel, and provides a series of corrugations along a bottom surface thereof which are engaged by the superior actuator arm segments to register the actuator slide body along the housing channel.

8 Claims, 6 Drawing Figures

DIP SWITCH

BACKGROUND OF THE INVENTION

1. The Field of the Invention

The present invention relates to DIP switches in general, and in particular to miniature DIP switches which are amenable to continuous mass manufacture and assembly.

2. The Prior Art

As real estate on circuitboards becomes more and more precious, electronic components, including switching components, have correspondingly decreased in size. DIP switches in particular have undergone a dramatic reduction in size within recent years, and the trend is toward even further miniaturization in the future. As a result, the industry is confronted with a multitude of problems in its attempt to provide economically produced, yet dimensionally small DIP switches for use on printed circuits.

U.S. Pat. Nos. 4,168,404, and 4,012,608 illustrate the state of the art in miniature DIP switch packaging. Pursuant to their disclosures, a sliding actuator unit is provided which may be manufactured in continuous strip form, and which comprises a plastic body integrally molded to conductive metallic strips. Portions of the carrier strip are subsequently made to project diagonally downward by a forming operation, for establishing electrical contact between circuit paths in the switch. In particular, the beams are formed in a diagonally crossing pattern, which establishes a circuit path between poles of the switch.

While the above switches provide components which are economical to produce, certain desirable features are absent. For example, it is desirable for a switch to provide positive registration means for registering the slide actuator along the switch housing channel. Such registration means should further provide for safeguarding the switch from inadvertent change in status, and provide for means for sealing the switch from exposure to dust and other external contaminents. Moreover, DIP switches presently available are relatively complicated in configuration, and accordingly are relatively difficult to manufacture and assemble in continuous strip fashion.

SUMMARY OF THE PRESENT INVENTION

The present invention relates to a DIP switch which is comprised of components which can be manufactured in continuous strip form. Specifically, the switch comprises a rectangular housing having circuit paths manufactured within the base surface thereof, a sliding actuator unit which is received within the rectangular housing channel, and which is intended for sliding location along the channel. The actuator unit comprises a plastic dielectric body which is molded directly to a metallic carrier strip. Subsequently, portions of the carrier strip are severed and formed to provide registration and contact springs for the actuator unit. A plurality of parallel arms as a result are provided to extend forwardly from the actuator body, with each of the forward arms providing a reversely formed, end segment which projects upwardly in superior relationship to the actuator body. The actuator unit further provides a plurality of spaced apart and parallel contact arms which are mechanically and electrically commoned at one end. The contact arms project rearwardly from the actuator body, and further comprise remote end segments which are reversely formed in dependent fashion. The actuator unit upon positionment within the housing channel, electrically interconnects circuit paths within the base of the housing by operational engagment of the depending spring arm segments against the circuit paths. A cover is further provided for enclosing the top of the housing channel, and functions to compress the actuator spring arm members to ensure positive electrical engagement between the depending arm segments and the circuit paths. In addition, the cover provides a bottom surface which is corrugated therealong for engagement by the upwardly projecting arm segments of the actuator body to thereby provide means for registering the actuator body along the housing channel.

Accordingly it is an object of the present invention to provide a miniature DIP switch comprised of readily assembled components.

Still further, it is an object of the present invention to provide a DIP switch comprised of integrally manufactured conductive and dielectric components.

A further object of the present invention is to provide a DIP switch having an improved actuator slide means configuration.

Yet a further object of the present invention is to provide a DIP switch comprised of components which are readily manufactured in continuous strip form.

Another object of the present invention is to provide a DIP switch having proved means for registering an actuator slide along the housing channel.

A further object of the present invention is to provide a miniature DIP switch which is economically and readily manufactured.

These and other objects, which will be apparent to one skilled in the art, are achieved by a preferred embodiment which is described in detail below, and which is illustrated in the accompanying drawings.

BRIEF DESCRIPTION OF THE ACCOMPANYING DRAWINGS

DETAILED DESCRIPTION OF THE PREFERRED EMBODIMENT

Figures 1, 6:
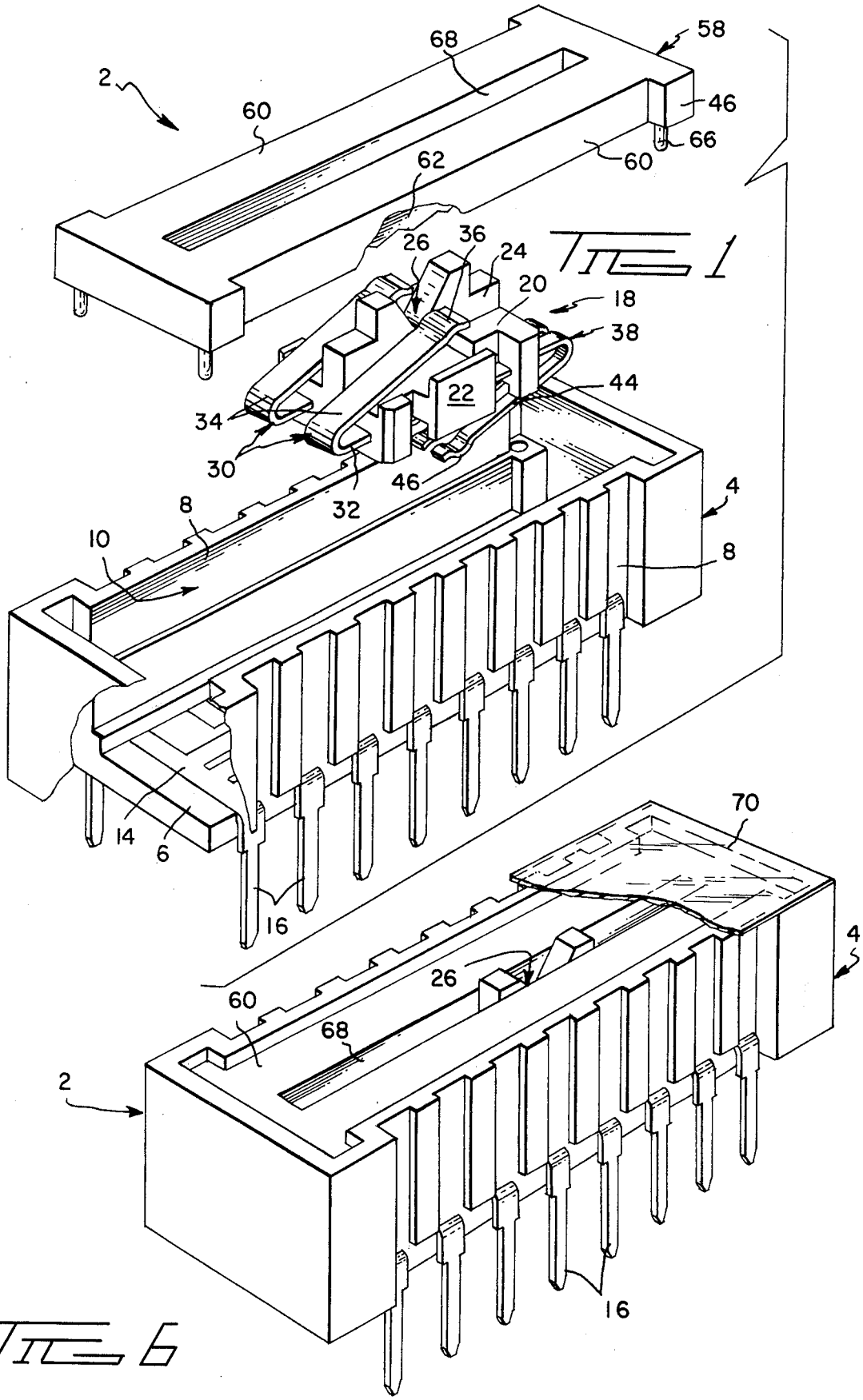
FIG. 1 is an exploded perspective view of the subject DIP switch assembly.
FIG. 6 is a perspective view of the assembled DIP switch of FIG. 5 illustrating the positionment of the dust cover component thereof.
Figure 2:
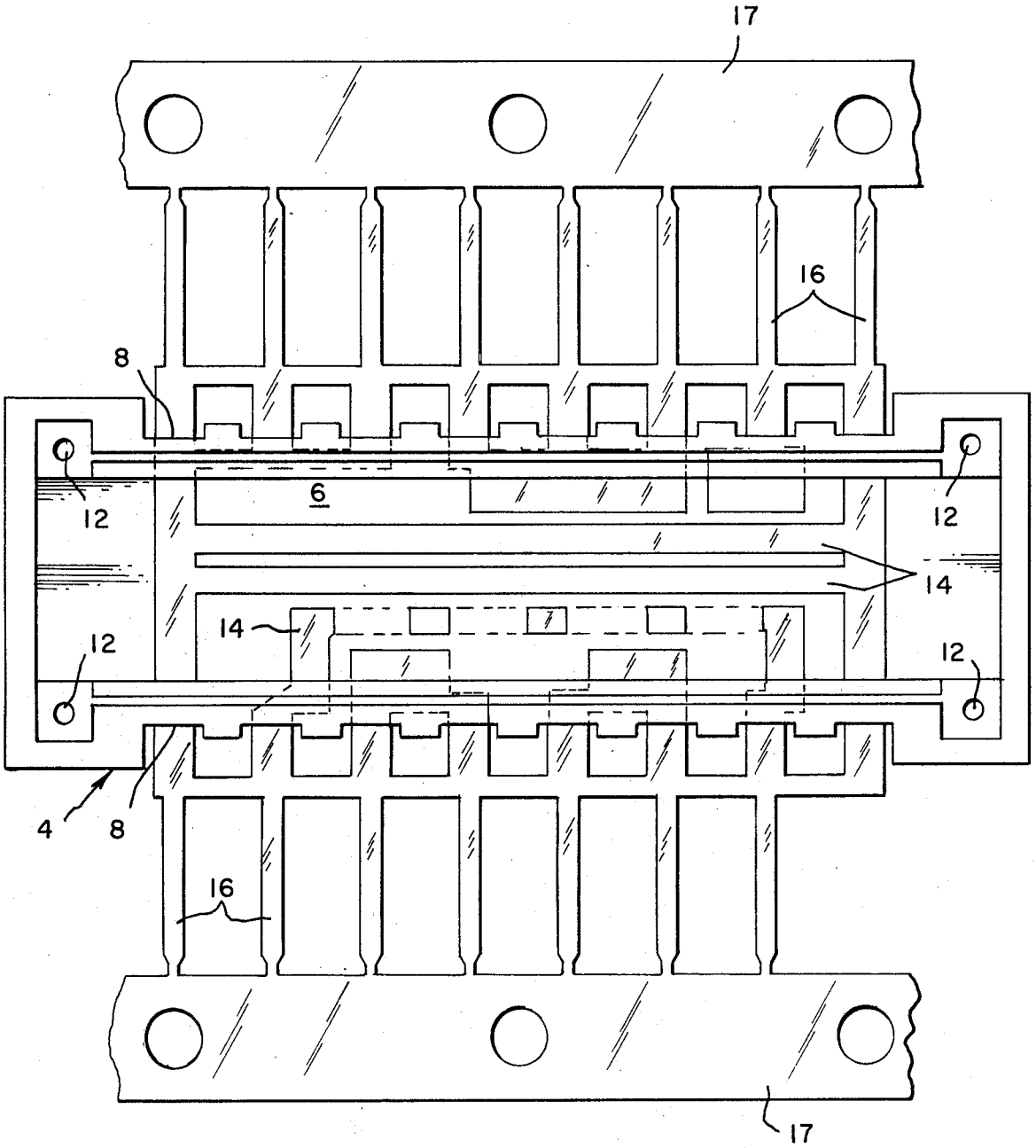
FIG. 2 is a top planar view of the DIP switch housing layout in a continuous strip form as manufactured.

Referring to FIG. 1, the subject DIP switch assembly 2 is illustrated as comprising a rectangular housing 4, constructed to provide a base wall 6 and opposing sidewalls 8 defining an elongated channel 10 therebetween. Located within the channel, and at each corner of the rectangular housing, is an integrally molded assembly socket 12. As illustrated, the base wall 6 of the housing 4 is provided with a conductive circuit pattern 14 inset therein. The circuitry pattern 14 is electrically continuous to the dual rows of contact legs 16 which are intended for insertion into the printed circuitboard. It will be appreciated from FIG. 2 that the subject switch housing is intended to be molded in continuous strip form. Subsequent to the manufacture of the housing, the contact legs 16 are severed from the carrier strip 17, and formed to depend downwardly as depicted in FIG. 1. A sealing of the legs 16 may be effectuated by injection of body 4 into a sealant material such as epoxy, thereby eliminating secondary epoxy sealing and subsequent curing thereof.

Figure 4:
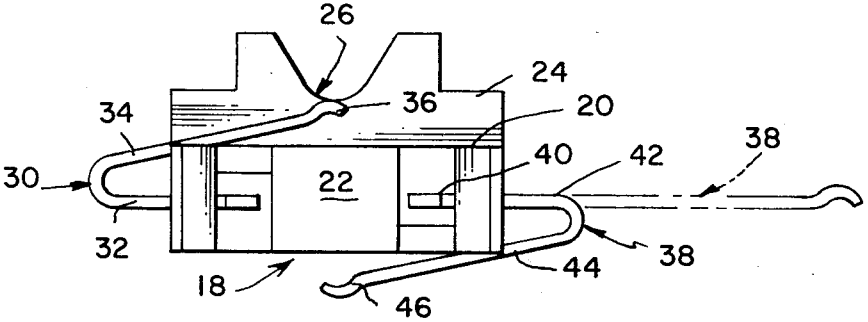
FIG. 4 is a side elevated view of the subject actuator unit of the present invention, shown subsequent to severment from the carrier strip of FIG. 3, and subsequent to the forming operation.

Referring to FIGS. 1 and 4, the subject actuator slide 18 comprises a molded plastic block 20 having a vertical wall 24 extending upwardly therefrom. A profiled notch 26 is provided within an upper surface of the vertical wall 24 for a purpose to be explained further below. A plurality of parallel and spaced apart spring arms 30 project forwardly from the actuator unit block 20, each spring arm 30 comprising a forward projecting segment 32, and a reversely formed end segment 34 adapted to project upwardly in superior relationship to the actuator block 20. An arcuate contact profile 36 is further provided at the remote end of each of the end segments 34. Continuing, a plurality of parallel and spaced apart contact arms 38 extend rearwardly from the actuator block 20, and are integrally connected at an inner end 40. Each of the contact arms 38 consist of a horizontal segment 42, and a reversely formed depending end segment 44. Each respective depending end segment 44 is likewise provided with an arcuate profile 46 at a remote end thereof.

Figure 3:
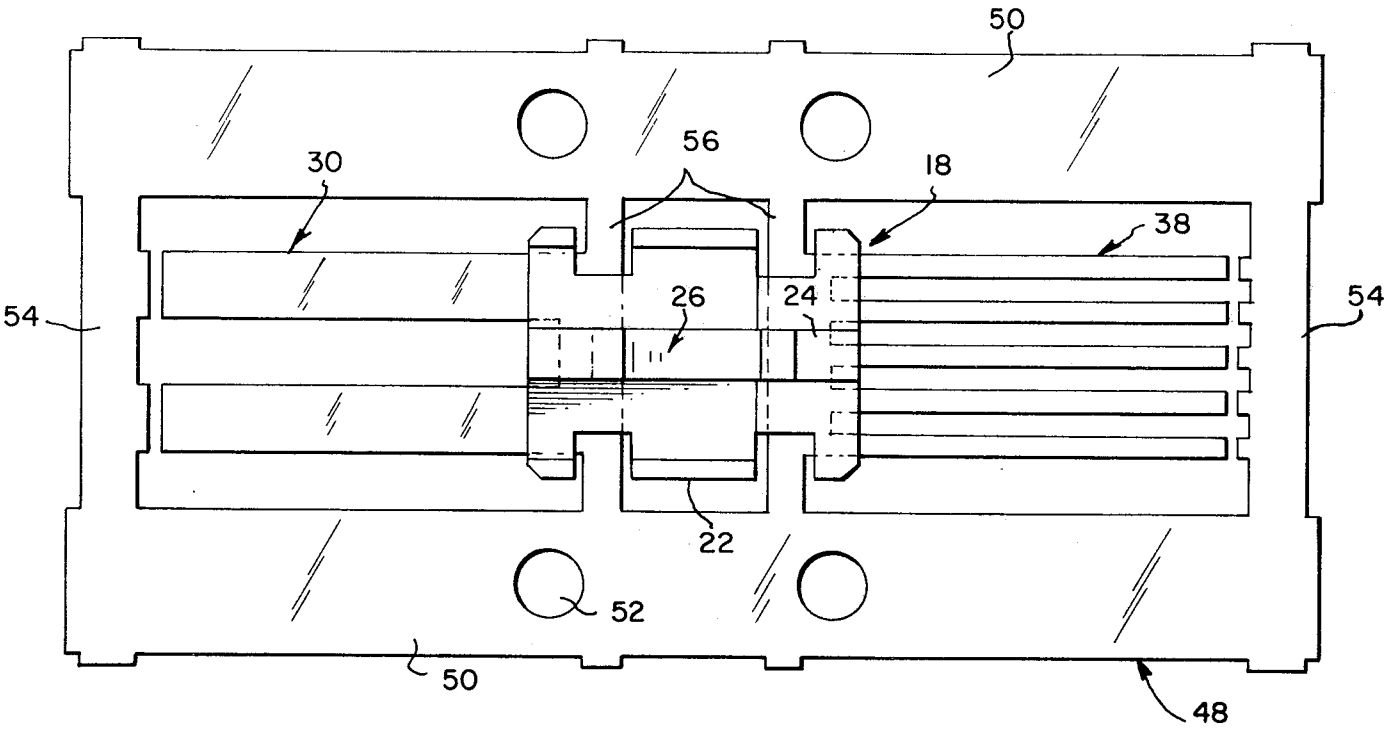
FIG. 3 is a top planar view of the actuator unit of the present invention, laid in continuous strip form as manufactured prior to a forming operation.

With reference of FIGS. 3 and 4, it will be appreciated that the actuator unit 18 is likewise intended to be manufactured in continuous strip form. Planar layout of the carrier strip is shown in FIG. 3 to comprise longitudinal edge strips 50 having serial apertures 52 therein which provide means for advancing the carrier strip 48. The longitudinal edge strips 50 of the carrier strip 48 are connected by a series of transverse outer support strips 54 and transverse inner support strips 56. It will be appreciated that the forward spring arms 30 are integrally joined to the outer transverse strips 54 at a forward end, and to the inner support strips 56 at a rearward end. Likewise, the contact arms 38 are joined to the outer transverse strips 54 at a forward end, and the inner strips 56 at a rearward end. The number of contact arms 38 is represented as being 5 in the preferred embodiment, but it will be appreciated to those skilled in the art that the number of contact arms may be varied without the departing from the teachings of the present invention. That is, depending on the circuit pattern layout of the switch, more or less contact arms can be provided if so desired.

The actuator unit spring arms 30 and contact arms 38 are severed from the carrier strip shown in FIG. 3, and subsequently undergo a forming operation which results in the configuration shown in FIG. 4. Thereafter, the actuator unit 18 is inserted into the elongate channel 10 of the switch housing 4. Referring to FIG. 1, a cover 58 is provided which comprises a planar body 60 having a corrugated undersurface 62 extending therealong. The body 60 is configured to provide a projection 64 at each respective corner thereof, with each projection 64 having an assembly post 66 depending therefrom. A longitudinal axial slot 68 extends subsequently along the length of the planar body 60.

Figure 5:
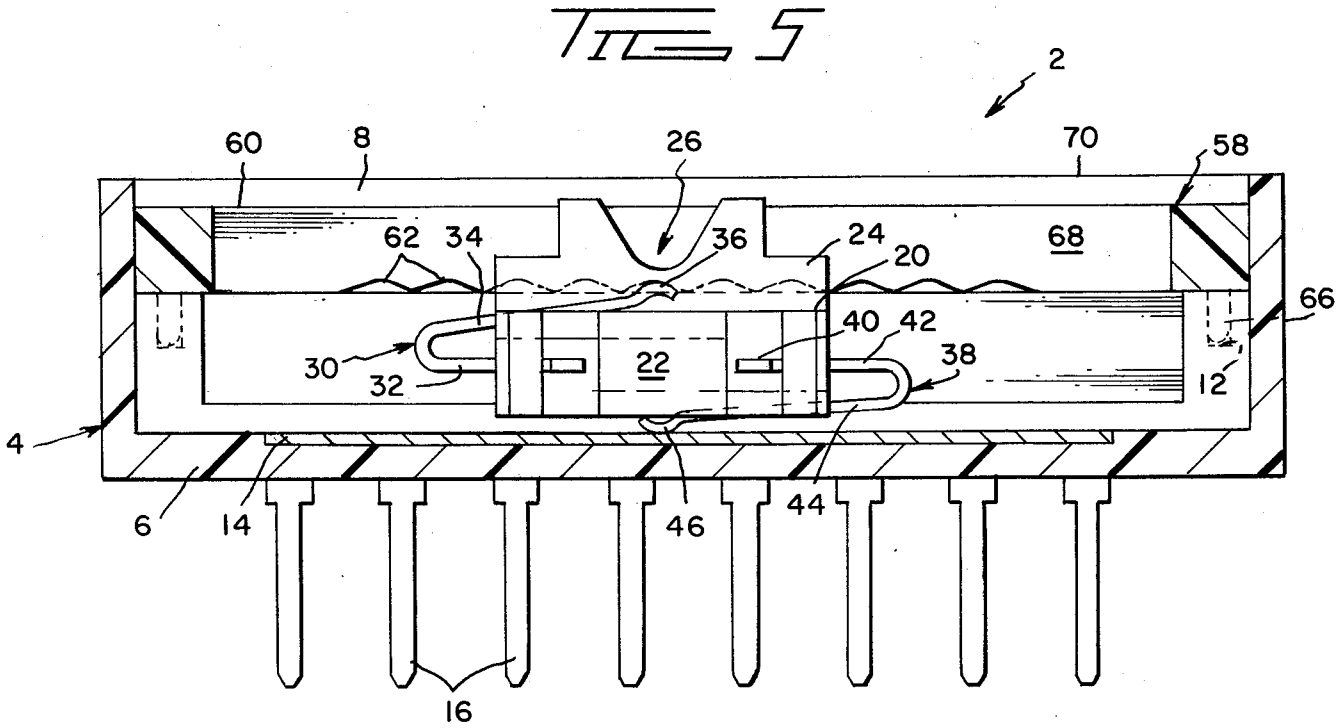
FIG. 5 is a side elevation view through a completely assembled DIP switch configured pursuant to the present invention.

With combined reference to FIGS. 1 and 5, upon positionment of the actuator unit 18 within the channel 10, the cover 58 is located over the channel 10, to encapsulate the actuator unit therein. The depending assembly posts 66 are press inserted into the assembly sockets 12 to mechanically secure the cover to the switch housing 4. In the assembled condition, the cover body 60 is recessed a distance below the upper surface of the switch housing as shown in FIG. 5. It will be appreciated that the cover 58 functions to compress the actuator spring arms 30 and the contact arms 38. Resultingly, the contact arms 38 are pressured against the circuit pattern inset 14 of the switch housing, and serve to electrically interconnect poles of the switch. Additionally, the cover compresses the spring arms 30 against the corrugated undersurface 62 of the cover. The arcuately profiled contact points 36 of the spring arms 30 reside within the undulating corrugations of the cover, and thereby serve to register the slide actuator at prescribed positions along the housing channel.

Referring to FIG. 6, it will be apparent that the profiled notch 26 of the actuator unit aligns with the longitudinal axis slot 68 of the cover 58. An elongate, slim profiled instrument, such as a screw driver blade (not shown), may thereby be inserted through the longitudinal slot 68 and into the profiled notch 26 to slide and position the actuator unit along the channel according to the switching program. A dust cover 70 is provided over the top of the switch housing 4, and serves to prevent dust and other contaminents from entering the cover slot 68 and potentially causing problems with electrical elements of the switch.

The above description of the preferred embodiment of the subject invention is not intended to be all-inclusive. Other embodiments which utilize the teachings herein set forth, and which will be apparent to one skilled in the art, are intended to be within the scope and spirit of the present invention.

What is claimed is:

1. A DIP switch comprising a housing having a base surface and sidewalls defining a channel therebetween, said base surface having circuitry means thereon;

slide body means receivable in and moveable along said channel, said body means having a plurality of spaced apart and parallel arms projecting forward therefrom, each said forward arm having a free, reversely formed, end segment projecting backwards toward, and superior to said body; and said slide body means having a plurality of spaced apart and parallel conductive arms, electrically and mechanically connected at one end and projecting rearward from said slide body means, each said rearward conductive leg having a reversely formed and depending opposite end sgement for engaging said circuitry means; and cover means for enclosing the top of said channel, and compressing said forward arm segments thereagainst, and said rearward opposite end segments against said circuitry means.

2. A DIP switch as set forth in claim 1, wherein said cover means having registration means along a bottom surface thereof for engagement against said forward leg segment to register said slide body means along said channel.

3. A DIP switch as set forth in claim 2, wherein said registration means along said bottom surface of said cover means comprising a series of transverse corrugations along said bottom cover means surface.

4. A DIP switch as set forth in claim 1, said cover means further having a longitudinal slot therethrough for accessing said slide body means to means for positioning said slide means along said channel.

5. A DIP switch as set forth in claim 4, wherein said slide body means comprising a solid dielectric body having a profiled notch opening toward said cover means slot.

6. A slide unit for a DIP switch or the like, comprising:

a body member having an elongate base and a vertically extending wall projecting perpendicularly upward from intermediate of said base;

a plurality of spaced apart and parallel arms projecting forwardly from said base, each said forward arm having a free, reversely formed, end segment backwardly projecting superior to said base and adjacent a respective side of said wall;

a plurality of spaced apart and parallel conductive arms electrically and mechanically connected at one end at said body base and projecting rearward from said base, each said rearward arm having a reversely formed, depending opposite end segment projecting backwards toward and beneath said base.

7. A slide unit as set forth in claim 6, wherein said wall projecting vertically from said base having a notch formed in an upper edge thereof.

8. A slide unit as set forth in claim 6, wherein each said opposite end segment of each said conductive arm having a remote, arcuately profiled end.

* * * * *